US012163732B2

(12) United States Patent
Yoo et al.

(10) Patent No.: US 12,163,732 B2
(45) Date of Patent: Dec. 10, 2024

(54) REFRIGERATOR

(71) Applicant: SAMSUNG ELECTRONICS CO., LTD., Suwon-si (KR)

(72) Inventors: Joosang Yoo, Suwon-si (KR); Seungyong Choi, Suwon-si (KR); Jonghoon Oh, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 308 days.

(21) Appl. No.: 17/684,837

(22) Filed: Mar. 2, 2022

(65) Prior Publication Data

US 2022/0333847 A1 Oct. 20, 2022

Related U.S. Application Data

(63) Continuation of application No. PCT/KR2022/000217, filed on Jan. 6, 2022.

(30) Foreign Application Priority Data

Apr. 15, 2021 (KR) ..... 10-2021-0049494
Sep. 28, 2021 (KR) ..... 10-2021-0127769

(51) Int. Cl.
*F25D 29/00* (2006.01)
*F25D 23/00* (2006.01)
(Continued)

(52) U.S. Cl.
CPC ..... *F25D 29/005* (2013.01); *F25D 23/006* (2013.01); *F25D 23/028* (2013.01); *F25D 23/10* (2013.01); *F25D 2400/40* (2013.01)

(58) Field of Classification Search
CPC .... F25D 23/006; F25D 23/10; F25D 2400/40; F25D 29/005; F25D 2400/36; F25D 23/00; F25D 23/028
See application file for complete search history.

(56) References Cited

U.S. PATENT DOCUMENTS 6,735,093 B2 * 5/2004 Mu-Tsai ..... G06F 1/183 361/802
8,162,421 B2 * 4/2012 Lim ..... F25D 23/02 312/401
(Continued)

FOREIGN PATENT DOCUMENTS

CN 1584462 A * 2/2005
CN 208170815 U 11/2018
(Continued)

OTHER PUBLICATIONS

KR19980019328 translation (Year: 1998).*
(Continued)

*Primary Examiner* — Hiwot E Tefera
(74) *Attorney, Agent, or Firm* — STAAS & HALSEY LLP

(57) ABSTRACT

A refrigerator including: a main body having a storage room; a door opening and closing the storage room; an electric box to accommodate a printed circuit board; and a guide case to accommodate the electric box, provided on a top surface of the main body, and including a guide rail formed to extend along a front-rear direction of the guide case to guide a movement of the electric box along the front-rear direction of the guide case.

15 Claims, 15 Drawing Sheets

(51) Int. Cl.
*F25D 23/02* (2006.01)
*F25D 23/10* (2006.01)

(56) References Cited

U.S. PATENT DOCUMENTS

| | | | | |
|---|---|---|---|---|
| 2004/0221605 | A1* | 11/2004 | Chae | F25D 29/005 62/298 |
| 2008/0113529 | A1* | 5/2008 | Kim | F25D 29/005 439/76.1 |
| 2015/0192355 | A1* | 7/2015 | Joo | F25D 29/005 312/401 |
| 2019/0200474 | A1* | 6/2019 | Miura | H05K 5/0026 |
| 2019/0313544 | A1* | 10/2019 | Miura | H05K 7/1427 |
| 2020/0182539 | A1* | 6/2020 | Hwang | F25D 23/02 |
| 2020/0363121 | A1 | 11/2020 | Kim et al. | |
| 2021/0063050 | A1* | 3/2021 | Yun | B01D 46/10 |
| 2022/0205702 | A1* | 6/2022 | Liu | B01D 46/46 |
| 2022/0397329 | A1* | 12/2022 | Goh | F25D 11/00 |

FOREIGN PATENT DOCUMENTS

| | | | | | |
|---|---|---|---|---|---|
| CN | 214537039 | U | * | 10/2021 | |
| EP | 0 660 448 | A2 | | 6/1995 | |
| EP | 1 475 592 | A2 | | 11/2004 | |
| JP | 2019-114687 | | | 7/2019 | |
| KR | 20-1998-0019328 | | | 7/1998 | |
| KR | 19980050656 | | * | 10/1998 | F25D 23/006 |
| KR | 19990032472 | U | * | 7/1999 | F25D 29/005 |
| KR | 200217769 | Y1 | * | 4/2001 | F25D 29/005 |
| KR | 20-0319651 | Y1 | | 7/2003 | |
| KR | 10-2004-0038360 | A | | 5/2004 | |
| KR | 20040038360 | A | * | 5/2004 | |
| KR | 10-2004-0095538 | A | | 11/2004 | |
| KR | 10-2015-0082058 | | | 7/2015 | |
| KR | 20210058234 | A | * | 5/2021 | |
| WO | WO-2021096301 | A1 | * | 5/2021 | F25D 11/00 |

OTHER PUBLICATIONS

KR 200217769 translation (Year: 2001).*

International Search Report dated May 3, 2022 in International Patent Application No. PCT/KR2022/000217 (4 pages; 5 pages English translation).

Extended European Search Report dated Mar. 12, 2024 for corresponding application No. 22788232.1.

* cited by examiner

REFRIGERATOR

CROSS-REFERENCE TO RELATED APPLICATION

This application is a continuation application, under 35 U.S.C. § 111(a), of international application No. PCT/KR2022/000217, filed Jan. 6, 2022, which is based on and claims priority under 35 U.S.C. § 119 to Korean Patent Provisional Application No. 10-2021-0049494, filed on Apr. 15, 2021, and Korean Patent Application No. 10-2021-0127769, filed on Sep. 28, 2021 in the Korean Intellectual Property Office, the disclosures of which are incorporated by reference herein in their entireties.

BACKGROUND

1. Field

The disclosure relates to a refrigerator, and more particularly, to a refrigerator with improved convenience.

2. Description of the Related Art

In general, a refrigerator is an appliance including a storage room and a cool air supplier for supplying cool air to the storage room to keep foods fresh. The temperature of the storage room is maintained within a constant temperature range required to keep foods fresh.

The refrigerator includes a main body, a printed circuit board on which electric parts for controlling internal devices of the main body are mounted, and an electric box accommodating the printed circuit board and accommodated inside the main body. However, when the electric parts and/or the printed circuit board breaks down, the electric parts and/or the printed circuit board need to be replaced with new one. However, in the case in which the electric box is installed inside the main body, it is required to move the refrigerator, which makes replacement of the printed circuit board difficult. Also, in the case in which the electric box is installed inside foam insulation, there is probability that the electric box will be deformed by the insulation.

Recently, there are needs for a refrigerator that can easily attach or detach the electric box to or from the main body without moving the main body and has low probability that the electric box will be deformed by the foam insulation.

SUMMARY

A refrigerator according to an embodiment of the disclosure includes: a main body having a storage room; a door provided to open and close the storage room; an electric box provided to accommodate a printed circuit board; and a guide case provided to accommodate the electric box and disposed on a top surface of the main body, and the guide case comprising a guide rail formed to extend along a front-rear direction of the guide case to guide a movement of the electric box along the front-rear direction of the guide case.

The guide case may include a lower case to be coupled to the top surface of the main body in which the electric box is to be accommodated, and the lower case is formed to cover both sides of the electric box.

The guide rail may formed to protrude from an inner side surface of the lower case toward a side surface of the electric box.

The electric box may include a sliding rail formed to protrude from the side surface of the electric box and to be positioned along the guide rail.

The guide rail is a first rail and the guide case may include: a second rail provided above the first rail such that the sliding rail is positioned between the first rail and the second rail, wherein a portion of the second rail is inclined upward toward a front direction.

The first rail may be formed to include a hole penetrating the first rail, and the electric box may include a stopper formed to protrude downward from a bottom of the sliding rail and insertable in the hole to thereby couple the electric box to the guide case.

The stopper may be formed to be separable from the hole as the electric box is moved upward.

The guide case may include: a third rail spaced from the first rail, behind the first rail and formed to extend along the front-rear direction of the guide case; a fourth rail spaced from the second rail, behind the second rail, formed to extend along the front-back direction of the guide case and above the third rail; and a rail stopper between a rear end of the third rail and a rear end of the fourth rail.

The guide case may include an insertion space between the third rail and the fourth rail such that a rear portion of the sliding rail is insertable into the insertion space, and a front portion of the third rail may be inclined downward toward the front direction and a front portion of the fourth rail may be inclined upward toward the front direction such that the insertion space is widened toward the front direction.

The refrigerator may further include a wire hole through which a wire electrically connected to the printed circuit board passes, the wire hole being formed behind the electric box and the lower case in the top surface of the main body.

The guide case may include an upper case positioned above the lower case and the wire hole and covering the lower case and the wire hole.

The upper case may include: a cover plate formed to extend along the front-rear direction of the guide case and above the guide case and the wire hole; and a case rib formed to protrude upward from a front end of the cover plate.

The electric box may include: an external wall forming an outer appearance of the electric box; an inner wall forming an accommodating space in which the printed circuit board is accommodated inside the electric box; a first guide protrusion formed to protrude from at least one of an outer surface of the inner wall or an inner surface of the outer wall, and guide a location of the wire inside the electric box; a second guide protrusion formed to protrude toward a rear direction of the electric box from a rear plate of the outer wall; a guide hole through which the wire passes, the guide hole being formed in the rear plate of the outer wall; and a buffer positioned behind the printed circuit board inside the electric box, and provided to surround the wire.

The refrigerator may further include: a hinge to rotatably couple the door to the main body; and a hinge mounting plate positioned at a front portion of the top surface of the main body, and to couple the hinge to the main body, wherein the guide case may include: a lower case to be coupled to the top surface of the main body to accommodate the electric box; an insertion protrusion to be inserted in the top surface of the main body and formed in a rear end of the lower case; and a coupling portion comprising a coupling hole screw-coupled with the hinge mounting plate, the coupling portion being provided in a front end of the lower case.

The refrigerator may further include a display to display operation information of the refrigerator, and formed to extend along a left-right direction to cover front sides of the electric box and the guide case.

A refrigerator according to an embodiment of the disclosure includes: a main body having a storage room; an electric box in which a printed circuit board is to be rested; and a guide case. The guide case may include a lower case including a wire hole through which a wire electrically connected to the printed circuit board passes and which penetrates a top wall of the main body in a rear portion of the main body, the lower case to be coupled to a top outer surface of the main body and including an accommodating space in which the electric box is to be accommodated, a guide rail formed to protrude from an inner surface of the lower case toward the electric box such that the electric box is movable along a front-back direction of the main body, and an upper case positioned above the lower case, the guide rail, and the wire hole to cover the lower case, the guide rail, and the wire hole.

The upper case may be provided above the guide case and the wire hole, and include a cover plate formed to extend along a front-back direction of the main body, and a case rib formed to protrude upward from a front end of the cover plate.

The refrigerator may further include a display formed to extend along a left-right direction in a front portion of the guide case and cover an upper portion of the front portion of the guide case.

The refrigerator may include a door opening and closing the storage room, a hinge rotatably coupling the door with the main body, and a hinge mounting plate positioned on the top outer surface of the main body and to be coupled to a front portion of the lower case and one end in left-right direction of the display.

A refrigerator according to an embodiment of the disclosure includes: a main body having a storage room; a door to be coupled with the main body to open and close the storage room; a hinge rotatably coupling the door with the main body; a hinge mounting plate provided at an outer corner portion of a top surface of the main body and to couple the hinge with the main body; an electric box positioned on a top outer surface of the main body, wherein a printed circuit board is rested in the electric box; and a case to accommodate the electric box and to be coupled with the top outer surface of the main body. According to an embodiment, the case includes a coupling portion to be coupled to the hinge mounting plate and provided in a front portion of the case, an insertion protrusion provided in a rear end of the case and insertable into the top surface of the main body, and a guide rail formed to protrude from a side inner surface of the case toward the electric box such that the electric box is movable along a front-back direction of the main body.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
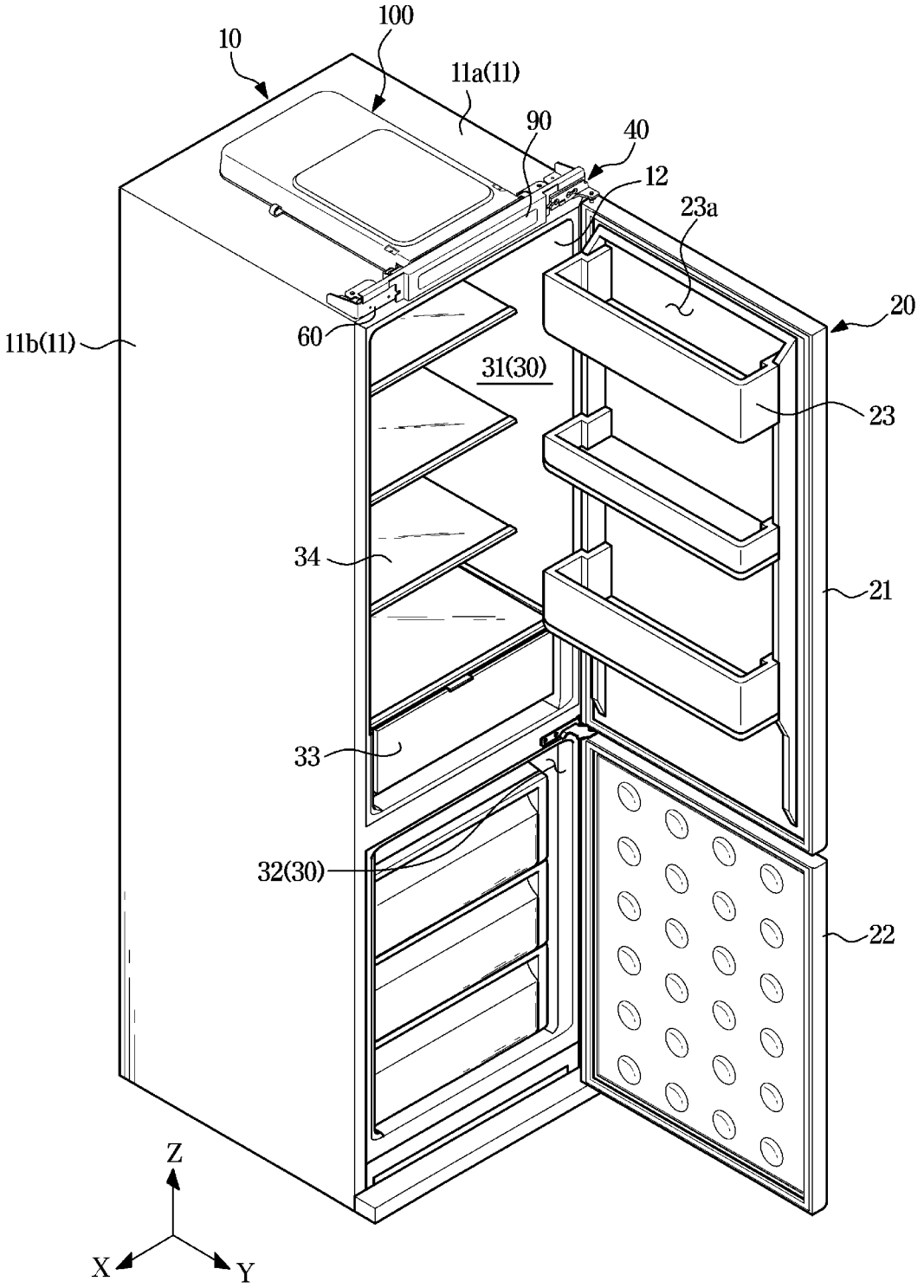
FIG. 1 is a perspective view of a refrigerator according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe embodiments, and are not intended to restrict and/or limit the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

It will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the disclosure. As used herein, the term "and/or" includes any and all combinations of one or more of associated listed items.

In the following description, the terms "front", "rear", "left", "right", etc. are defined based on the drawings, and the shapes and positions of the corresponding components are not limited by the terms.

Throughout the disclosure, the expression "at least one of a, b or c" indicates only a, only b, only c, both a and b, both a and c, both b and c, all of a, b, and c, or variations thereof.

It is an aspect of the disclosure to provide a refrigerator capable of easily attaching or detaching an electric box to or from a main body.

It is another aspect of the disclosure to provide a refrigerator with improved service workability.

Hereinafter, embodiments of the present disclosure will be described in detail with reference to the accompanying drawings.

Figure 2:
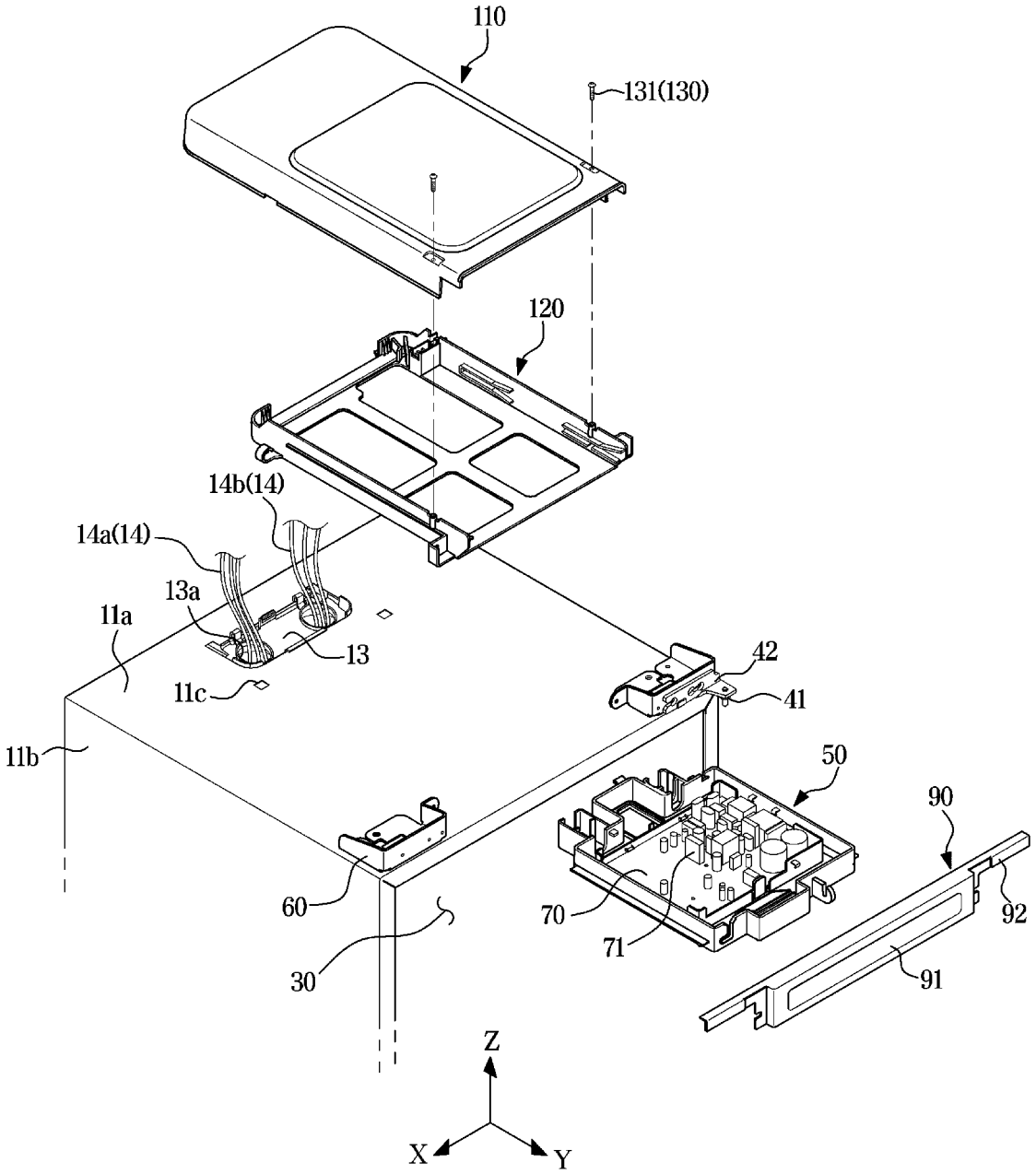
FIG. 2 is an exploded perspective view of the refrigerator shown in FIG. 1.

FIG. 1 is a perspective view of a refrigerator according to an embodiment of the disclosure. FIG. 2 is an exploded perspective view of the refrigerator shown in FIG. 1.

Referring to FIGS. 1 and 2, a refrigerator 1 according to an embodiment of the disclosure may include a main body 10.

On a top surface of the main body 10, an electric box 50 and/or a guide case 100 may be positioned. For example, on an outer surface of the main body 10, the electric box 50 and/or the guide case 100 may be positioned. The main body 10 may include an outer case 11 and an inner case 12. The outer case 11 may form an outer appearance of the refrigerator 1. The outer case 11 may be substantially in a shape of a rectangular parallelepiped. The outer case 11 may include the top surface 11*a*, side surfaces 11*b*, a rear surface, and a bottom surface. The electric box 50 and/or the guide case 100 may be positioned outside the outer case 11. For example, the guide case 100 for guiding a location or movement of the electric box 50 may be positioned on the outer surface of a top wall of the outer case 11. The top surface 11*a* of the main body 10 may be the outer surface of the top wall of the outer case 11. For ease of illustration, the top surface 11*a* of the main body 10 is hereinafter referred to as a top outer surface 11*a*. However, an arrangement or locations of the guide case 100 and the electric box 50 are not limited to the above-described example, and the guide case 100 and the electric box 50 may be positioned at various other locations such as an outer surface of a bottom wall of the outer case 11.

The inner case 12 may be installed inside the outer case 11. The inner case 12 may form a storage room 30. The inner case 12 may be substantially in a shape of a rectangular parallelepiped.

The storage room 30 may include a first storage room 31 and a second storage room 32. The first storage room 31 may be a refrigerating room 31, and the second storage room 32 may be a freezing room 32. The refrigerating room 31 may be provided at an upper location than the freezing room 32, although not limited thereto. However, the refrigerating room 31 may be provided at a lower location than the freezing room 32. Food may be stored in the storage room 30.

The refrigerator 1 may include a storage container 33 and a shelf 34. The storage container 33 and the shelf 34 may be positioned inside the storage room 30. Food may be put on the shelf 34, and food may be stored in the storage container 33. The numbers or shapes of the shelf 34 and the storage container 33 are not limited to an example shown in the drawings.

The refrigerator 1 may include a door 20. The door 20 may be rotatably coupled with the main body 10 to open and close the storage room 30. The door 20 may include a first door 21 for opening and closing the first storage room 31, and a second door 22 for opening and closing the second storage room 32. In the drawings, two doors 20 are shown, however, four doors or a single door may be provided.

The refrigerator 1 may further include a door shelf 23. The door shelf 23 may be coupled with the door 20. The door shelf 23 may be coupled with an inner side of the door 20. In the door shelf 23, a storage space 23*a* in which food is stored may be provided. The door shelf 23 may protrude toward the inside of the storage room 30 upon closing of the storage room 30 by the door 20.

The refrigerator 1 may further include a hinge 40 and a hinge mounting plate 60.

The hinge 40 may couple the door 20 with one side of the main body 10. The hinge 40 may enable the door 20 to rotate with respect to the main body 10. The hinge 40 may include a hinge shaft 41 and a hinge coupling plate 42. A portion of the hinge shaft 41 may be inserted into the door 20. Also, another portion of the hinge shaft 41 may be inserted into the hinge coupling plate 42. The hinge coupling plate 42 may be coupled with the hinge mounting plate 60. The hinge coupling plate 42 may be coupled with a front surface of the hinge mounting plate 60 to thereby couple the hinge 40 with the main body 10.

The hinge mounting plate 60 may couple the hinge 40 with the main body 10. The hinge mounting plate 60 may be coupled with the main body 10. For example, the hinge mounting plate 60 may be coupled with the top outer surface 11*a* of the main body 10. A plurality of hinge mounting plates 60 may be provided. Accordingly, the hinge 40 may be coupled with the door 20 at an edge in X or −X direction of the main body 10. However, the number of the hinge mounting plates 60 is not limited to that shown in the drawings.

The refrigerator 1 may include a guide plate 13 and a wire 14.

The guide plate 13 may be coupled with the top outer surface 11*a* of the top wall of the outer case 11. The guide plate 13 may include a wire hole 13*a* for guiding the wire 14.

The wire 14 may penetrate the wire hole 13*a* and/or the top outer surface 11*a* of the main body 10. For example, the wire 14 may penetrate top plates of the outer case 11 and the inner case 12. The wire 14 may be electrically connected to various devices (not shown) provided inside the main body 10. Also, the wire 14 may be electrically connected to a printed circuit board 70 positioned on the top outer surface 11*a* of the top wall of the outer case 11. The guide plate 13 may be positioned behind the electric box 50.

A plurality of wires 14 may be provided. The plurality of wires 14 may include a first wire 14*a* and a second wire 14*b*. For example, the first wire 14*a* may be electrically connected to the printed circuit board 70 to control the devices installed in the main body 10, and the second wire 14*b* may be electrically connected to the printed circuit board 70 to supply power to the devices installed in the main body 10. However, functions of the first wire 14*a* and the second wire 14*b* are not limited to the above-described example.

The refrigerator 1 may further include the electric box 50. The electric box 50 may be positioned on the top outer surface 11*a* of the top wall of the outer case 11. For example, the electric box 50 may be positioned on the top outer surface 11*a* of the outer case 11. The electric box 50 may accommodate the printed circuit board 70. For example, the printed circuit board 70 on which electric parts 71 are mounted may be positioned inside the electric box 50. The electric box 50 may move in a front-back direction on the top outer surface 11*a* of the top wall of the outer case 11. Details about this will be described below.

The refrigerator 1 may further include the guide case 100. The guide case 100 may guide a movement or location of the electric box 50 in the front-back direction of the main body 10. For example, the electric box 50 may be put into or taken out of the guide case 100 along a front-back direction of the outer case 11. The guide case 100 may include an upper case 110 and a lower case 120.

The upper case 110 may cover the lower case 120 from above the lower case 120. The upper case 110 may cover the guide plate 13 in which the wire hole 13*a* is formed. Because the upper case 110 covers both the lower case 120 and the guide plate 13, the lower case 120, the electric box 50, the wire 14, and the guide plate 13 may be not seen from outside the refrigerator 1. Accordingly, the beauty of the outer appearance of the refrigerator 1 may be improved. However, the upper case 110 may be omitted. The upper case 110 is also referred to as a cover 110.

The lower case 120 may be coupled with the top outer surface 11*a* of the top wall of the outer case 11. The lower case 120 may accommodate the electric box 50 therein. The lower case 120 is also referred to as a case 120. The lower case 120 may be positioned below the upper case 110. For example, the lower case 120 may be positioned between the upper case 110 and the top outer surface 11*a* of the outer case 11 along a Z direction (for example, an up-down direction). The lower case 120 may be positioned in front of the wire hole 13*a*. The lower case 120 may be positioned behind the display 90. For example, the lower case 120 may be positioned between the display 90 and the wire hole 13*a* along a Y direction (for example, the front-back direction). The lower case 120 may be coupled with the top outer surface 11*a* of the top wall of the outer case 11 through an insertion protrusion 128. For example, the insertion protrusion 128 may be inserted into an insertion protrusion hole 11*c* formed in the top outer surface 11*a* of the outer case 11.

The refrigerator 1 may further include the display 90. The display 90 may display an operation state of the refrigerator 1. For example, the display 90 may display inside temperature, etc. of the storage room 30. However, functions of the display 90 are not limited to the above-described example. The display 90 may cover a front side of the guide case 100. Accordingly, the guide case 100 and the electric box 50 may be not exposed as seen from the front of the main body 10. However, the display 90 may be omitted. The display 90 may be coupled with the main body 10. For example, the display 90 may be coupled with the hinge mounting plate 60 to cover front sides of the guide case 100 and the electric box 50. The display 90 may include a display portion 91 and a coupling portion 92. The display 91 may display an operation state of the refrigerator 1, and the coupling portion 92 may be coupled with the hinge mounting plate 60. The display portion 91 may be provided between the coupling portions 92. The coupling portion 92 may be provided at both sides of the display portion 91.

Figure 3:
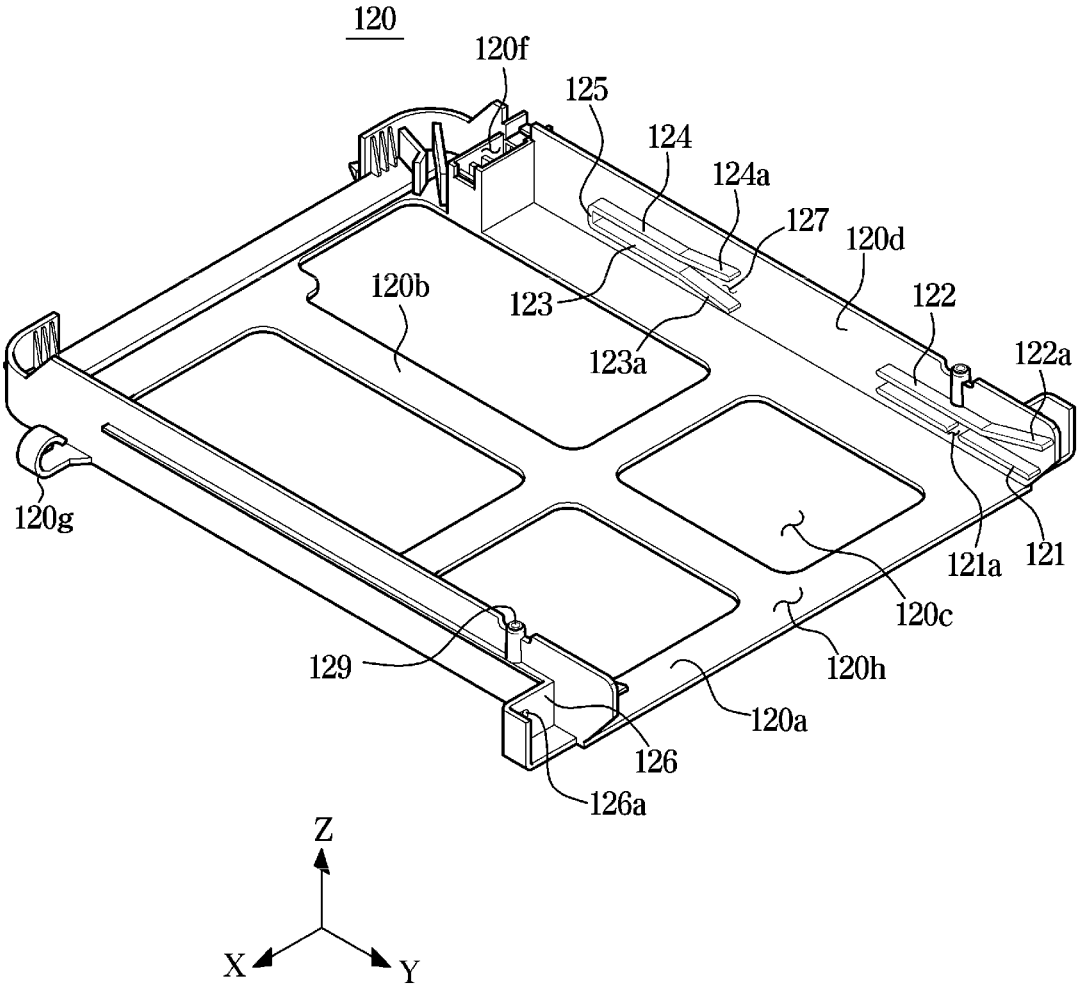
FIG. 3 is a perspective view showing a lower case of a guide case in the refrigerator shown in FIG. 2.
Figure 4:
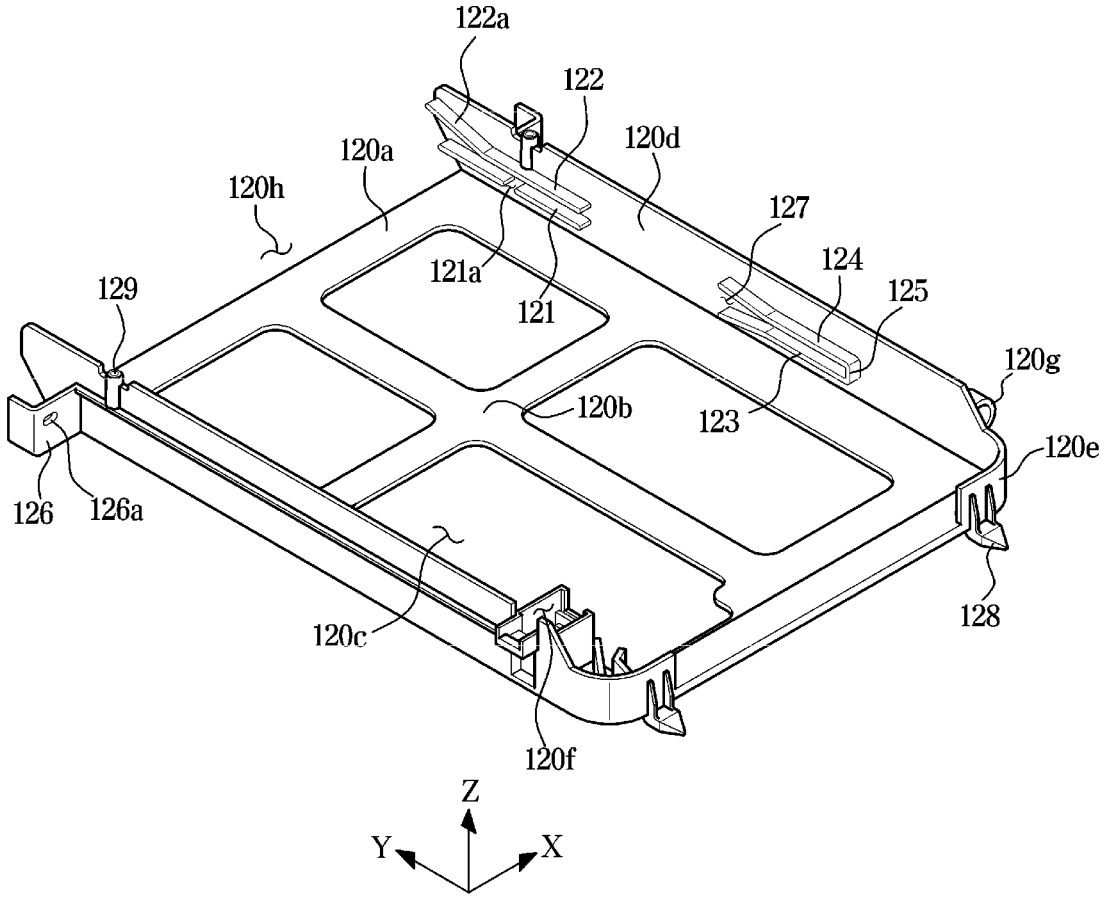
FIG. 4 is a perspective view of the lower case of FIG. 3, shown at another angle.

FIG. 3 is a perspective view showing a lower case of a guide case in the refrigerator shown in FIG. 2. FIG. 4 is a perspective view of the lower case of FIG. 3, shown at another angle.

Referring to FIGS. 3 and 4, the refrigerator 1 according to an embodiment of the disclosure may include the guide case 100. The guide case 100 may include the lower case 120.

The lower case 120 may accommodate the electric box 50. The lower case 120 may cover a bottom and sides 50*b* of the electric box 50. The lower case 120 may surround the electric box 50.

The lower case 120 may include a base 120*a*, a support rib 120*b*, a hole 120*c*, and code guides 120*f* and 120*g*. The base 120*a* may accommodate the electric box 50. The base 120*a* may form an outer circumference of the lower case 120. The support rib 120*b* may connect side plates 120*d* and/or a rear plate 120*e* of the lower case 120. The support rib 120*b* may cross the base 120*a*. However, a shape of the support rib 120*b* is not limited to the above-described example. The support rib 120*b* may prevent the shape of the lower case 120 from being deformed. The hole 120*c* may be formed between the base 120*a* and the support rib 120*b*. The base 120*a* and the support rib 120*b* may form an accommodating space for accommodating the electric box 50 in the lower case 120. The code guides 120*f* and 120*g* may guide an arrangement of a code (not shown) connected to the wire 14.

Also, the front side of the lower case 120 may open. For example, in the front side of the lower case 120, an opening 120*h* may be formed. The opening 120*h* may enable the electric box 50 to be put into or taken out of the lower case 120 along the front-back direction (see FIG. 10).

The guide case 100 may include guide rails 121, 122, 123, and 124. The guide rails 121, 122, 123, and 124 may guide the electric box 50 to move along the front-back direction of the main body 10. The guide rails 121, 122, 123, and 124 may extend in the front-back direction. The guide rails 121, 122, 123, and 124 may be formed in the lower case 120. For example, the guide rails 121, 122, 123, and 124 may be formed on inner side surfaces 120*d* of the lower case 120. The guide rails 121, 122, 123, and 124 may protrude from inner surfaces of the side plates 120*d* of the lower case 120 toward the inside of the lower case 120 in which the electric box 50 is accommodated. For example, the guide rails 121, 122, 123, and 124 may protrude toward the X direction from the inner surfaces of the side plates 120*d*, although not limited thereto. However, the guide rails 121, 122, 123, and 124 may protrude upward from the base 120*a* of the lower case 120. Also, the guide rails 121, 122, 123, and 124 may be components included in the upper case 110. A user may easily put the electric box 50 into the guide case 100 or take the electric box 50 out of the guide case 100 through the guide rails 121, 122, 123, and 124 and a sliding rail 52.

The guide rails 121, 122, 123, and 124 may be a first rail 121, a second rail 122, a third rail 123, a fourth rail 124, and include a rail stopper 125.

The first rail 121 may be provided in a front portion of the lower case 120. The first rail 121 may be positioned below the second rail 122. The first rail 121 may be a lower rail 121. Upon positioning of the electric box 50 in the lower case 120, the sliding rail 52 may be guided between the first rail 121 and the second rail 122. A stopper hole 121*a* may be formed in the first rail 121. The stopper 53 provided in the electric box 50 may be inserted into the stopper hole 121*a*. The stopper 53 may be inserted into the stopper hole 121*a* to prevent the electric box 50 from departing from the lower case 120 in a front direction. The stopper 53 may be a front stopper 53.

The second rail 122 may be provided in the front portion of the lower case 120. The second rail 122 may be positioned above the first rail 121. The second rail 122 may be an upper rail 122. Upon positioning of the electric box 50 in the lower case 120, the sliding rail 52 may be guided between the second rail 122 and the first rail 121. The second rail 122 may include an inclined portion 122*a*. The inclined portion

122*a* may be formed at a front portion 122*a* of the second rail 122. The inclined portion 122*a* may be inclined upward toward the front direction. An insertion space 127 between the first rail 121 and the second rail 122 may be widened by the inclined portion 122*a*. Accordingly, upon inserting of the electric box 50 between the first rail 121 and the second rail 122, the electric box 50 may be more easily inserted between the first rail 121 and the second rail 122 than in a case in which no inclined portion 122*a* exists.

The third rail 123 may be provided in a rear portion of the lower case 120. The third rail 123 may be positioned below the fourth rail 124. The third rail 123 may be a lower rail 123. Upon positioning of the electric box 50 in the lower case 120, the sliding rail 52 may be guided between the third rail 123 and the fourth rail 124. The third rail 123 may include an inclined portion 123*a* (see FIG. 8). The inclined portion 123*a* may be formed at a front portion of the third rail 123. The inclined portion 123*a* may be inclined downward toward the front direction. An insertion space 127 between the third rail 123 and the fourth rail 124 may be widened by the inclined portion 123*a*. Accordingly, upon inserting of the electric box 50 between the third rail 123 and the fourth rail 124, the electric box 50 may be more easily inserted between the third rail 123 and the fourth rail 124 than in a case in which no inclined portion 123*a* exists.

The fourth rail 124 may be provided in the rear portion of the lower case 120. The fourth rail 124 may be positioned above the third rail 123. The fourth rail 124 may be an upper rail 124. Upon positioning of the electric box 50 in the lower case 120, the sliding rail 52 may be guided between the fourth rail 124 and the third rail 123. The fourth rail 124 may include an inclined portion 124*a*. The inclined portion 124*a* may be formed at a front portion of the fourth rail 124. The inclined portion 124*a* may be inclined upward toward the front direction. An insertion space 127 between the third rail 123 and the fourth rail 124 may be widened by the inclined portion 124*a*. Accordingly, upon inserting of the electric box 50 between the third rail 123 and the fourth rail 124, the electric box 50 may be more easily inserted between the third rail 123 and the fourth rail 124 than in a case in which no inclined portion 124*a* exists.

The electric box 50 may move on the lower rails 121 and 123 of the guide rails 121, 122, 123, and 124. For example, the electric box 50 may be put into or taken out of the guide case 100 in the front-back direction by the lower rails 121 and 123.

The rail stopper 125 may be connected to one ends of the third rail 123 and the fourth rail 124. For example, the rail stopper 125 may be connected to rear ends of the third rail 123 and the fourth rail 124. The rail stopper 125 may stop the sliding rail 52 to prevent the electric box 50 from excessively moving in a rear direction. The rail stopper 125 may be a rear stopper 125. The front stopper 53 and the rear stopper 125 may guide a location in front-back direction of the electric box 50.

The guide case 100 may include a coupling portion 126, the insertion protrusion 128, and a cover coupling portion 129. The coupling portion 126, the insertion protrusion 128, and the cover coupling portion 129 may be formed in the lower case 120.

The coupling portion 126 may be formed in the front portion of the lower case 120. The coupling portion 126 may be formed at both sides of the side plates 120*d* of the lower case 120. For example, the coupling portion 126 may extend in a left direction from a left side plate 120*d* of the lower case 120, or in a right direction from a right side plate 120*d* of the lower case 120. A plurality of coupling portions 126 may be provided. A coupling hole 126*a* may be formed in each coupling portion 126. The coupling portion 126 may be coupled with the hinge mounting plate 60 provided on the top outer surface 11*a* of the top wall of the outer case 11 through a screw 132. The screw 132 may penetrate the hinge mounting plate 60 and the coupling hole 126*a* (see FIG. 9).

The insertion protrusion 128 may be formed in the rear portion of the lower case 120. For example, the insertion protrusion 128 may protrude from the rear plate 120*e* of the lower case 120 toward the rear direction. The insertion protrusion 128 may penetrate the top outer surface 11*a* of the outer case 11 to couple the guide case 100 with the outer case 11. For example, the insertion protrusion 128 may be inserted into the insertion protrusion hole 11*c* of the outer case 11. A plurality of insertion protrusions 128 may be provided. The plurality of insertion protrusions 128 may be spaced from each other in a left-right direction. However, the number and locations of the insertion protrusions 128 are not limited to the above-described example.

The cover coupling portion 129 may be screw-coupled with the upper case 110. The cover coupling portion 129 may be positioned in the front portion of the lower case 120. The cover coupling portion 129 may be positioned behind the coupling portion 126. The cover coupling portion 129 may be formed at both the side plates 120*d* of the lower case 120.

Figure 5:
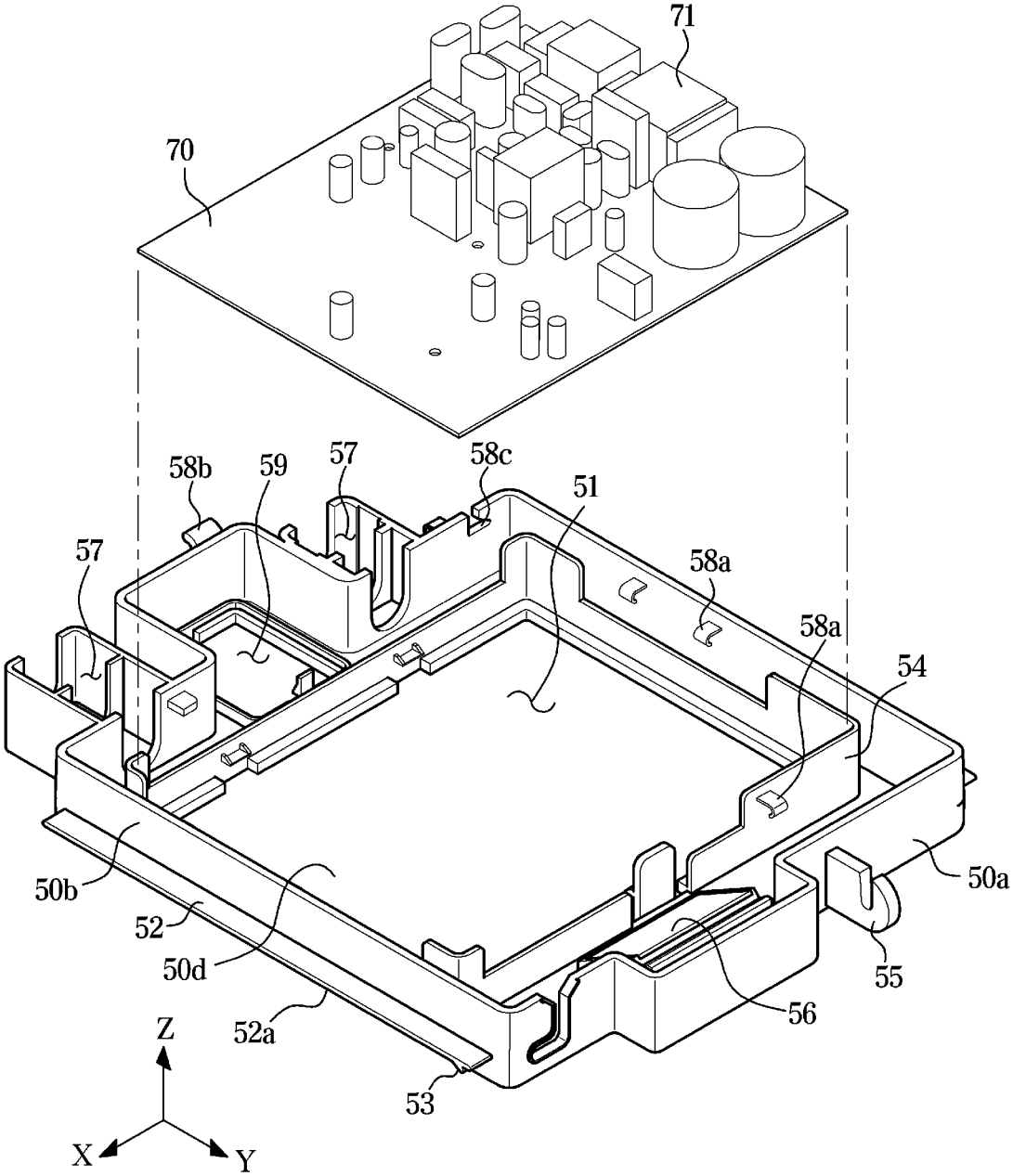
FIG. 5 is a perspective view showing an electric box in the refrigerator shown in FIG. 2.
Figure 6:
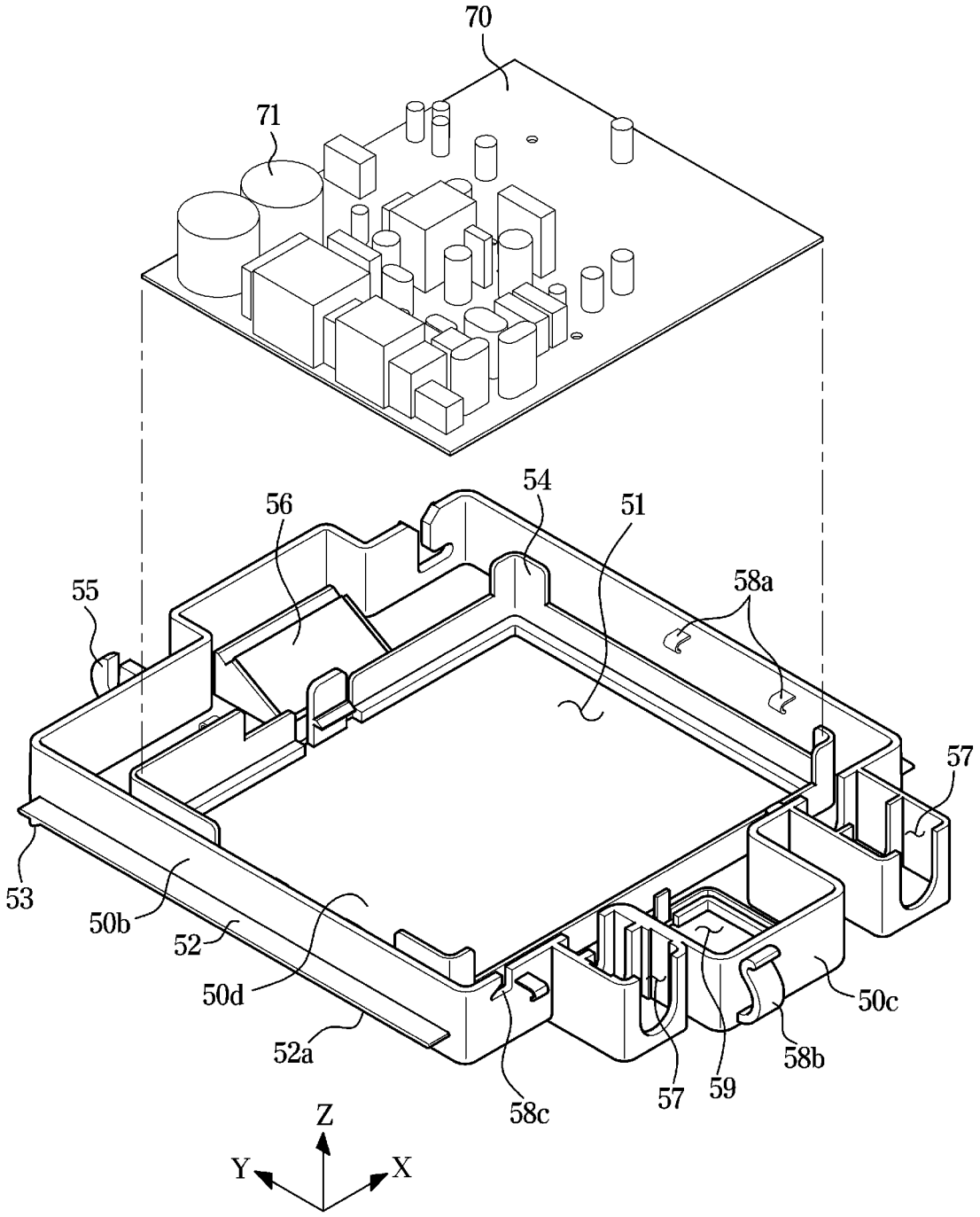
FIG. 6 is a perspective view of the electric box of FIG. 5, shown at another angle.

FIG. 5 is a perspective view showing an electric box in the refrigerator shown in FIG. 2. FIG. 6 is a perspective view of the electric box of FIG. 5, shown at another angle.

Referring to FIGS. 5 and 6, the refrigerator 1 according to an embodiment of the disclosure may include the printed circuit board 70 and the electric box 50 accommodating the printed circuit board 70.

The electric parts 71 may be mounted on the printed circuit board 70. The printed circuit board 70 may be electrically connected to the wire 14. The printed circuit board 70 may be electrically connected to various devices (not shown) provided inside the main body 10 through the wire 14.

The electric box 50 may include an accommodating space 51 and an accommodating space forming wall 54. The electric box 50 may accommodate the printed circuit board 70 in the accommodating space 51. The printed circuit board 70 may be rested in the accommodating space 51. The printed circuit board 70 may be in contact with a bottom 50*d* of the electric box 50. The accommodating space forming wall 54 may form the accommodating space 51. The accommodating space forming wall 54 may surround the accommodating space 51. The accommodating space forming wall 54 may be an inner wall 54. A wall forming an outer appearance of the electric box 50 may be an external wall. The external wall may include a front plate 50*a*, a side plate 50*b*, and a rear plate 50*c*.

The electric box 50 may include the sliding rail 52 and the stopper 53.

The sliding rail 52 may protrude outward from the side plate 50*b* of the electric box 50. The sliding rail 52 may extend along the front-back direction. The sliding rail 52 may slide between the guide rails 121, 122, 123, and 124. The sliding rail 52 may cause the electric box 50 to slide in the front-rear direction of the outer case 11. The sliding rail 52 may be a sliding rib 52.

However, the sliding rail 52 may slide on the lower rails 121 and 123 of the guide rails 121, 122, 123, and 124. For example, the sliding rail 52 may move in the front-back direction on the lower rails 121 and 123.

The stopper 53 may protrude downward from a bottom 52*a* of the sliding rail 52. The stopper 53 may be inserted in the stopper hole 121*a* formed in the first rail 121 of the electric box 50 accommodated in the lower case 120. The stopper 53 may fix the electric box 50 in the lower case 120 by preventing the electric box 50 from departing from the lower case 120. For example, the stopper 53 may prevent the electric box 50 from departing in the front direction of the main body 10 from the lower case 120. Accordingly, the stopper 53 may function to prevent the electric box 50 from departing in the front direction from the lower case 120, and the rail stopper 125 may function to prevent the electric box 50 from departing in the rear direction from the lower case 120.

The electric box 50 may include a buffer accommodating portion 57. The buffer accommodating portion 57 may be formed in a rear portion of the electric box 50. A buffer 141 for reducing tension that is applied to the wire 14 may be accommodated in the buffer accommodating portion 57.

The electric box 50 may include a plurality of guide protrusions 58*a* and 58*b*. The guide protrusions 58*a* and 58*b* may guide a location of the wire 14 in the electric box 50, or guide a movement of the wire 14 upon taking out of the electric box 50. Also, the guide protrusions 58*a* and 58*b* may prevent the wire 14 from being tangled in the electric box 50. A plurality of wires 14 may be provided, and the guide protrusions 58*a* and 58*b* may guide the individual wires 14 to prevent the plurality of wires 14 from contacting each other or being shorted out. The guide protrusions 58*a* and 58*b* may protrude from the inner wall 54 of the electric box 50 and/or an outer wall of the electric box 50. The guide protrusions 58*a* and 58*b* may include a first guide protrusion 58*a* and a second guide protrusion 58*b*. The first guide protrusion 58*a* may protrude from at least one of an outer surface of the inner wall 54 or an inner surface of the external wall to guide an arrangement of the wires 14 in the electric box 50. The second guide protrusion 58*b* may protrude in the rear direction from the rear plate 50*c* of the electric box 50.

The electric box 50 may further include a guide hole 58*c*. The wires 14 may pass through the guide hole 58*c*. The guide hole 58*c* may penetrate the rear plate 50*c*.

The electric box 50 may include a handle 55. The handle 55 may be provided in the front portion of the electric box 50. For example, the handle 55 may protrude forward from the front plate 50*a*. A user may put or take the electric box 50 into or out of the guide case 100 and/or the main body 10 by using the handle 55. The handle 55 may be in a shape of a hook. However, the shape of the handle 55 is not limited to that shown in the drawings.

A communication module 56 may be accommodated in the electric box 50. The communication module 56 may be provided in the front portion of the electric box 50 to transmit or receive data and/or signals to or from an external device of the refrigerator 1.

The electric box 50 may further include a circuit breaker accommodating portion 59. The circuit breaker accommodating portion 59 may be provided in the rear portion of the electric box 50, and accommodate a circuit breaker (not shown) for breaking overcurrent flowing through the wires 14 and/or various devices.

Figure 7:
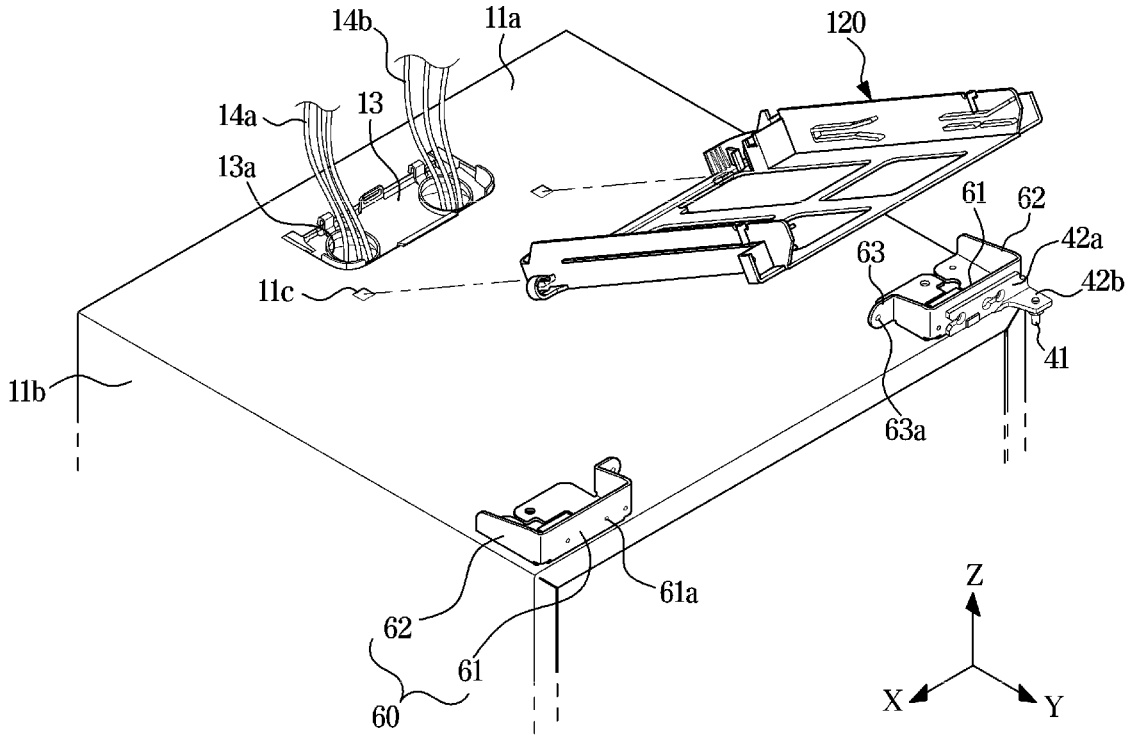
FIG. 7 is a perspective view showing a state in which a lower case is coupled with an upper surface of a main body in the refrigerator shown in FIG. 2.
Figure 8:
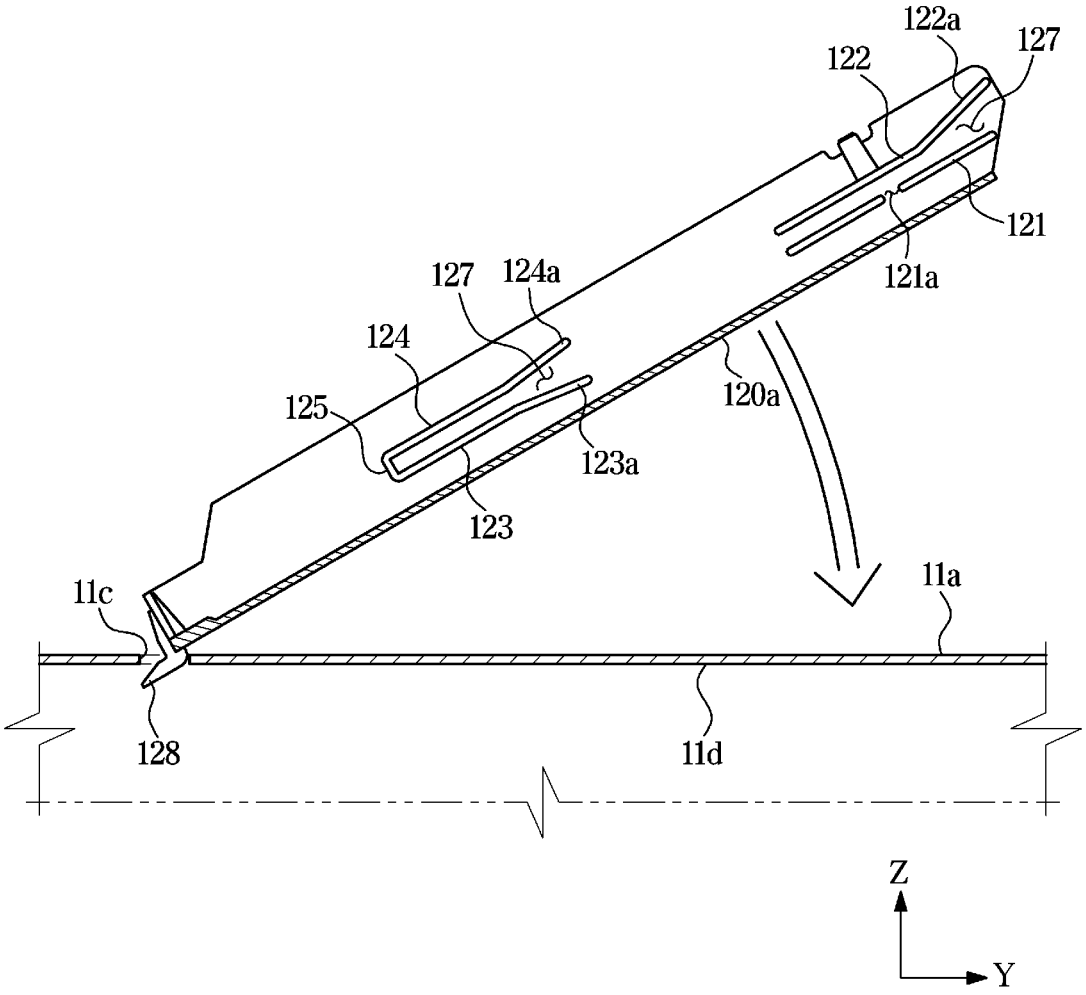
FIG. 8 is a cross-sectional view showing a state in which the lower case is coupled with the upper surface of the main body in the refrigerator shown in FIG. 7.
Figure 9:
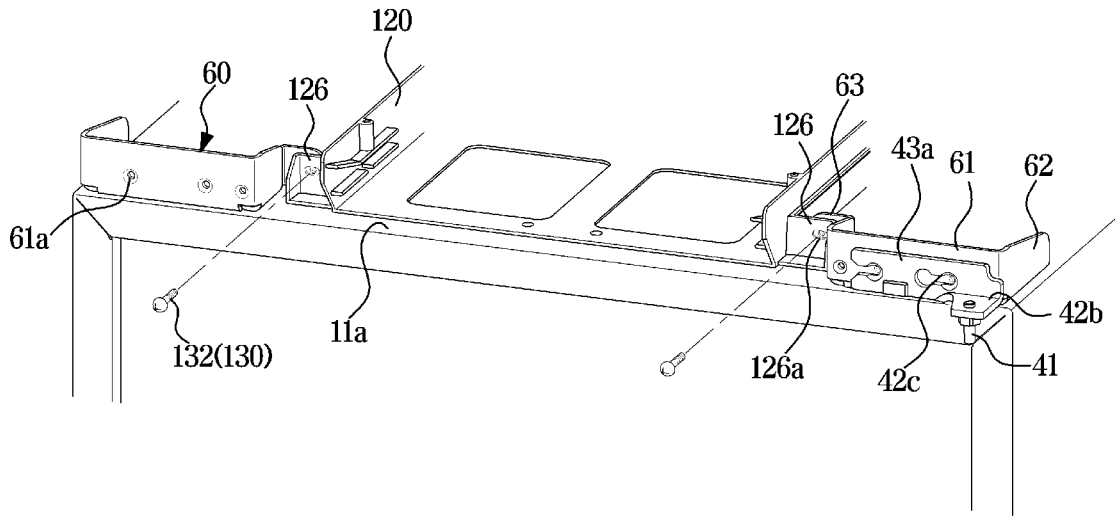
FIG. 9 is a perspective view showing a state in which the lower case is coupled with the upper surface of the main body in the refrigerator shown in FIG. 7.

FIG. 7 is a perspective view showing a state in which a lower case is coupled with an upper surface of a main body in the refrigerator shown in FIG. 2. FIG. 8 is a cross-sectional view showing a state in which the lower case is coupled with the upper surface of the main body in the refrigerator shown in FIG. 7. FIG. 9 is a perspective view showing a state in which the lower case is coupled with the upper surface of the main body in the refrigerator shown in FIG. 7.

Referring to FIGS. 7 to 9, the refrigerator 1 according to an embodiment of the disclosure may include the hinge 40 and the hinge mounting plate 60.

The hinge 40 may include the hinge shaft 41 and the hinge coupling plate 42. The hinge shaft 41 may couple the door 20 with the hinge coupling plate 42. The hinge shaft 41 may extend in the up-down direction. The hinge coupling plate 42 may include a first coupling portion 42*a* and a second coupling portion 42*b*. The first coupling portion 42*a* may be coupled with a front plate 61 of the hinge mounting plate 60, and the second coupling portion 42*b* may protrude forward from the first coupling portion 42*a* and be coupled with the hinge shaft 41. The first coupling portion 42*a* may be screw-coupled with the front plate 61. A coupling hole 42*c* for screw-coupling the first coupling portion 42*a* with the front plate 61 may be formed in the first coupling portion 42*a*.

The hinge mounting plate 60 may couple the hinge 40 with the main body 10. The hinge mounting plate 60 may be coupled with the top outer surface 11*a* of the outer case 11. The hinge mounting plate 60 may be positioned at a corner portion of the top outer surface 11*a* of the outer case 11. The hinge mounting plate 60 may include the front plate 61, a side plate 62, and a coupling plate 63. The front plate 61 may include a coupling hole 61*a* to be screw-coupled with the hinge coupling plate 42. The front plate 61 may be in contact with the first coupling portion 42*a*. The coupling plate 63 may be positioned at an inner portion than the corner portion on the top outer surface 11*a* of the outer case 11. The coupling plate 63 may be coupled with the coupling portion 126 of the lower case 120 through the screw 132.

Hereinafter, a process for coupling the guide case 100 with the outer case 11 will be described with reference to FIGS. 7 to 9, below.

Referring to FIGS. 7 and 8, in the refrigerator 1 according to an embodiment of the disclosure, the lower case 120 of the guide case 100 may be coupled with the top outer surface 11*a* of the outer case 11. The lower case 120 may be inserted into the insertion protrusion hole 11*c* formed in the top outer surface 11*a* of the outer case 11. For example, the insertion protrusion 128 provided in a rear end of the lower case 120 may be inserted into the insertion protrusion hole 11*c*. The insertion protrusion 128 may penetrate the top wall 11*d* of the outer case 11. Accordingly, the lower case 120 may be rested on the top outer surface 11*a* of the outer case 11.

Referring to FIG. 9, as a result of resting of the lower case 120 on the top outer surface 11*a* of the outer case 11, the coupling portion 126 may be located in front of the coupling plate 63 of the hinge mounting plate 60. The coupling plate 63 may be screw-coupled with the coupling portion 126.

Accordingly, the lower case 120 may be fixed to the outer case 11, by the insertion protrusion 128 provided in the rear portion and inserted into the top outer surface 11*a* of the outer case 11, and the coupling portion 126 provided at both sides of the front portion and coupled with the hinge mounting plate 60 provided at the corner portion of the top outer surface 11*a* of the outer case 11.

Figure 10:
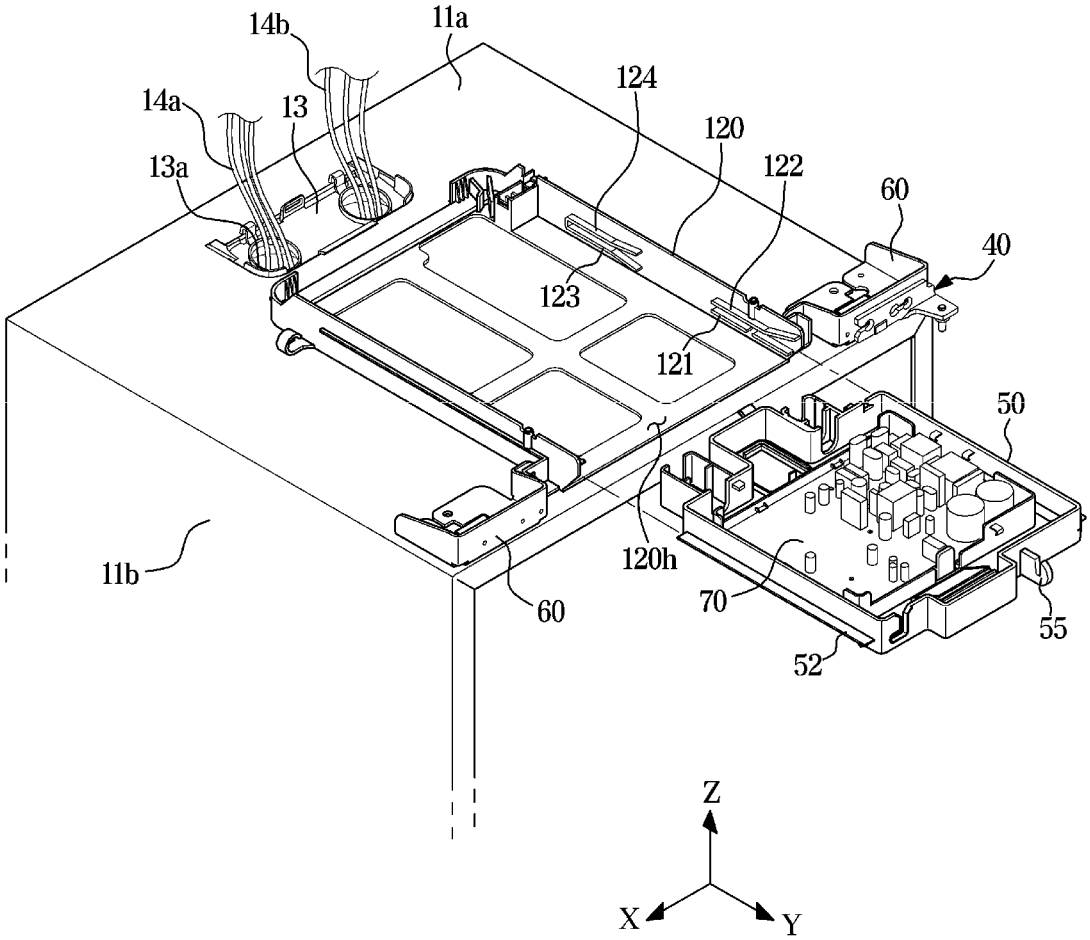
FIG. 10 is a perspective view showing a state in which an electric box is separated from a guide case in the refrigerator shown in FIG. 2.
Figure 11:
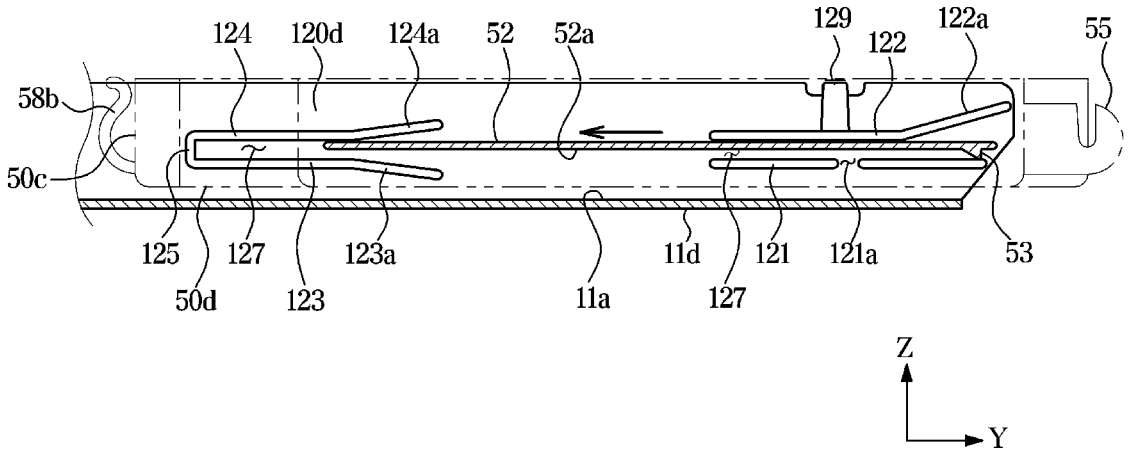
FIG. 11 is a cross-sectional view showing a state in which the electric box is coupled with the guide case in the refrigerator shown in FIG. 10.
Figure 12:
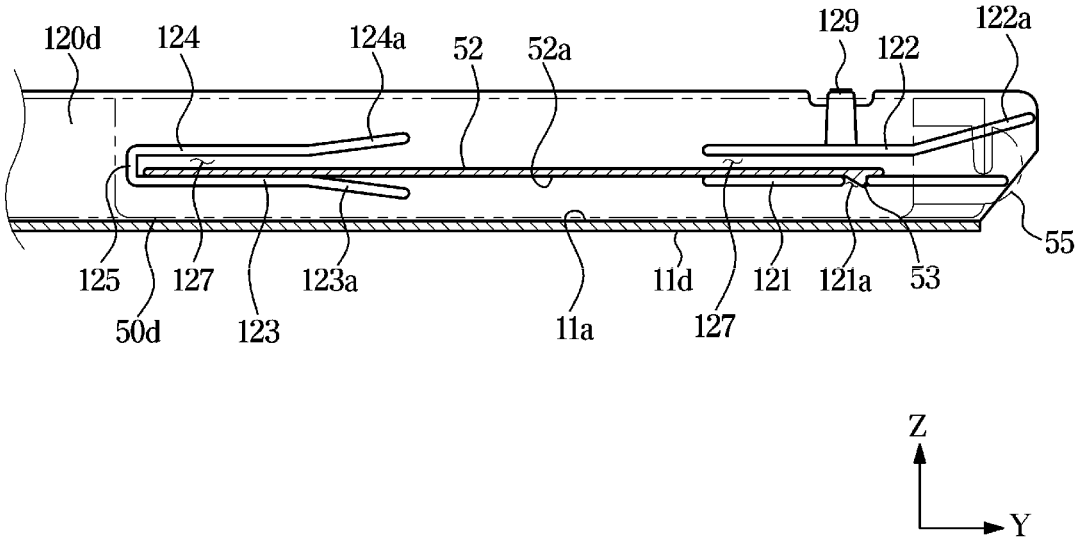
FIG. 12 is a perspective view showing a state in which the electric box is coupled with the guide case in the refrigerator shown in FIG. 10.

FIG. 10 is a perspective view showing a state in which an electric box is separated from a guide case in the refrigerator shown in FIG. 2. FIG. 11 is a cross-sectional view showing a state in which the electric box is coupled with the guide case in the refrigerator shown in FIG. 10. FIG. 12 is a perspective view showing a state in which the electric box is coupled with the guide case in the refrigerator shown in FIG. 10.

Referring to FIGS. 10 to 12, in the refrigerator 1 according to an embodiment of the disclosure, the electric box 50 may be put into or taken out of the guide case 100 along the front-rear direction of the outer case 11. A process by which the electric box 50 is put into the guide case 100 will be described with reference to FIGS. 10 to 12.

For the electric box 50 to be put into the guide case 100, the electric box 50 positioned in the front portion of the guide case 100 may move toward the rear direction. Accordingly, the sliding rail 52 may be inserted between the guide rails 121, 122, 123, and 124. For example, the sliding rail 52 may be inserted between the first rail 121 and the second rail 122. Because the second rail 122 includes the inclined portion 122*a*, the sliding rail 52 may be easily inserted into the insertion space 127 between the first rail 121 and the second rail 122.

The sliding rail 52 inserted between the first rail 121 and the second rail 122 may continue to move in the rear direction and thus be inserted between the third rail 123 and the fourth rail 124. Because the third rail 123 and the fourth rail 124 include the inclined portions 123*a* and 124*a*, the sliding rail 52 may be easily inserted into the insertion space 127 between the third rail 123 and the fourth rail 124. The sliding rail 52 may be easily inserted between the third rail 123 and the fourth rail 124 until the stopper 53 is inserted in the stopper hole 121*a* or a rear end of the sliding rail 52 contacts the rail stopper 125. According to inserting of the stopper 53 of the sliding rail 52 in the stopper hole 121*a*, the electric box 50 may be accommodated in the lower case 120. The stopper 53 may prevent the electric box 50 from departing in the front direction from the guide case 100. At this time, the bottom 50*d* of the electric box 50 may be in contact with the top outer surface 11*a* of the outer case 11.

As described above, the sliding rail 52 may slide to be inserted into the insertion space 127. Also, the sliding rail 52 may be easily put into the insertion space 127 through the inclined portions 122*a*, 123*a*, and 124*a*. As such, a user may easily locate the electric box 50 on the top outer surface 11*a* of the outer case 11 by pushing the front portion of the electric box 50 in the rear direction, which raises the user's convenience of use.

Also, in the case of a built-in type refrigerator, it may be possible to put the electric box 50 into the main body 10 and the guide case 100 without moving the refrigerator.

Figure 13:
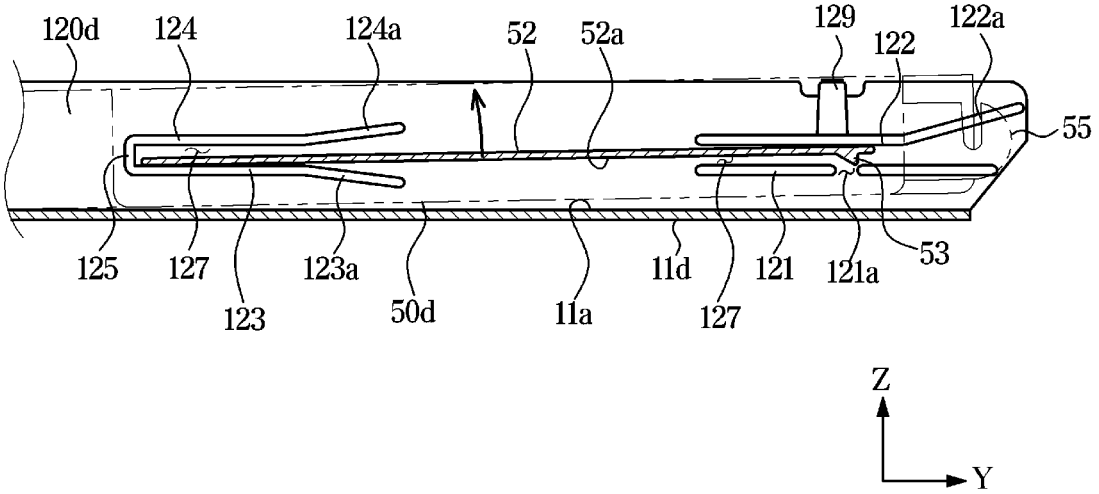
FIG. 13 is a cross-sectional view showing a state in which the electric box is separated from the guide case in the refrigerator shown in FIG. 10.

FIG. 13 is a cross-sectional view showing a state in which the electric box is separated from the guide case in the refrigerator shown in FIG. 10.

Referring to FIG. 13, in the refrigerator 1 according to an embodiment of the disclosure, the electric box 50 may be positioned inside the guide case 100. For example, the electric box 50 may be accommodated between the lower case 120 and the upper case 110. In a case in which the electric box 50 needs to be separated from the guide case 100, the electric box 50 may be taken out of the guide case 100 along the front-back direction of the outer case 11 without separating the upper case 110 from the lower case 120, which will be described below.

Hereinafter, a process by which the electric box 50 is taken out of the guide case 100 will be described with reference to FIG. 13.

For the computing device 50 to be taken out of the guide case 100, a user may move the electric box 50 rested on the guide case 100 upward. For example, the user may move the handle 55 provided in a front end of the lower case 120 upward to move the front portion of the electric box 50 upward. At this time, the bottom 50*d* of the electric box 50 may be lifted from the top outer surface 11*a* of the outer case 11, and accordingly, the stopper 53 may be separated from the stopper hole 121*a*. After the stopper 53 is separated from the stopper hole 121*a*, the user may pull the handle 55 in the front direction to take the electric box 50 out in the front direction (the Y direction). Thereby, the sliding rail 52 may be taken out of the insertion space 127.

As described above, because the sliding rail 52 slides to be taken out of the insertion space 127, the user may easily separate the electric box 50 from the main body 10 by using the handle 55 of the electric box 50, thereby increasing the user's convenience of use.

Also, in a case of a built-in type refrigerator, it may be possible to take the electric box 50 out of the main body 10 and the guide case 100 without moving the refrigerator.

Figure 14:
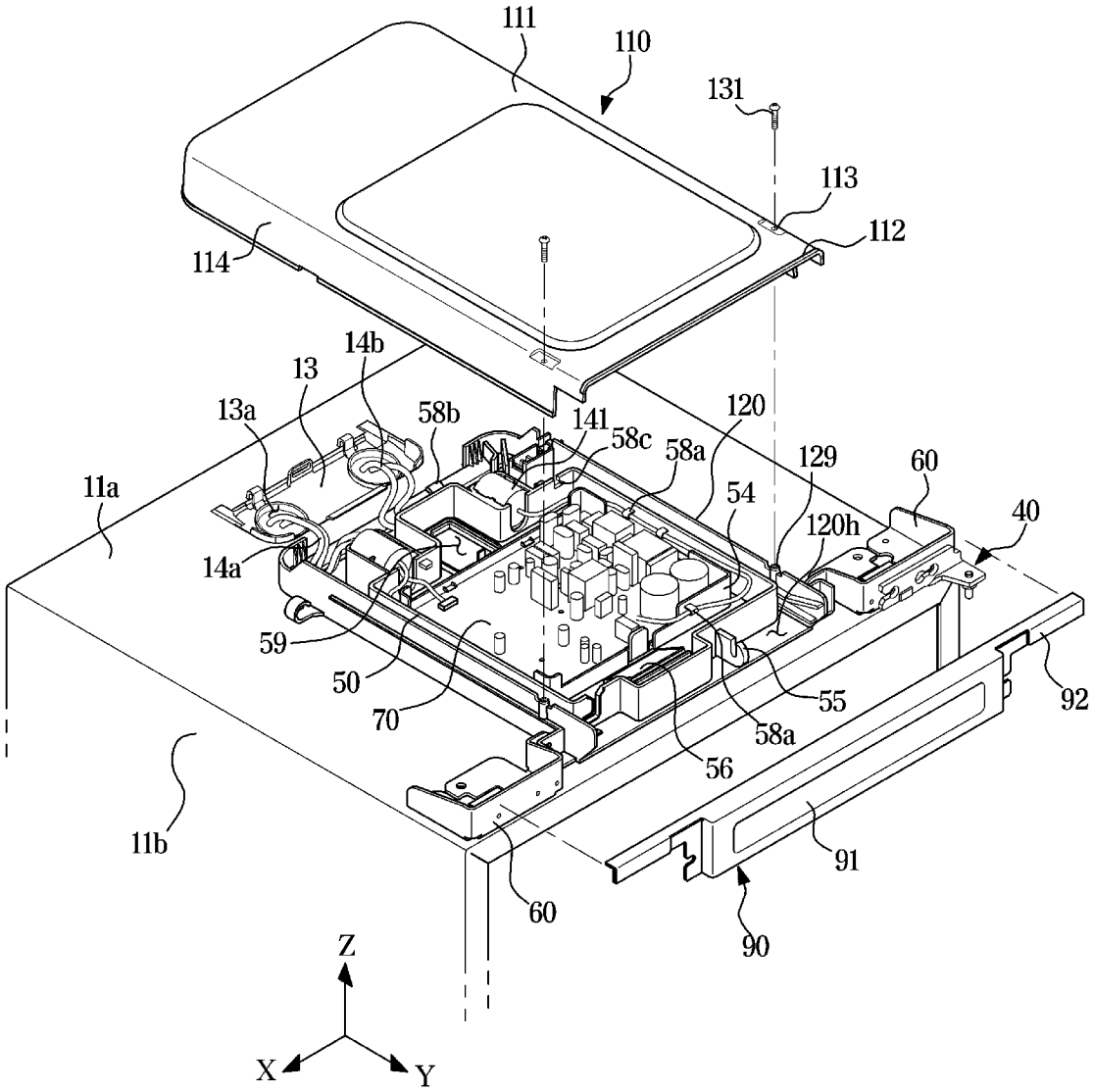
FIG. 14 is an exploded perspective view of the refrigerator shown in FIG. 2.
Figure 15:
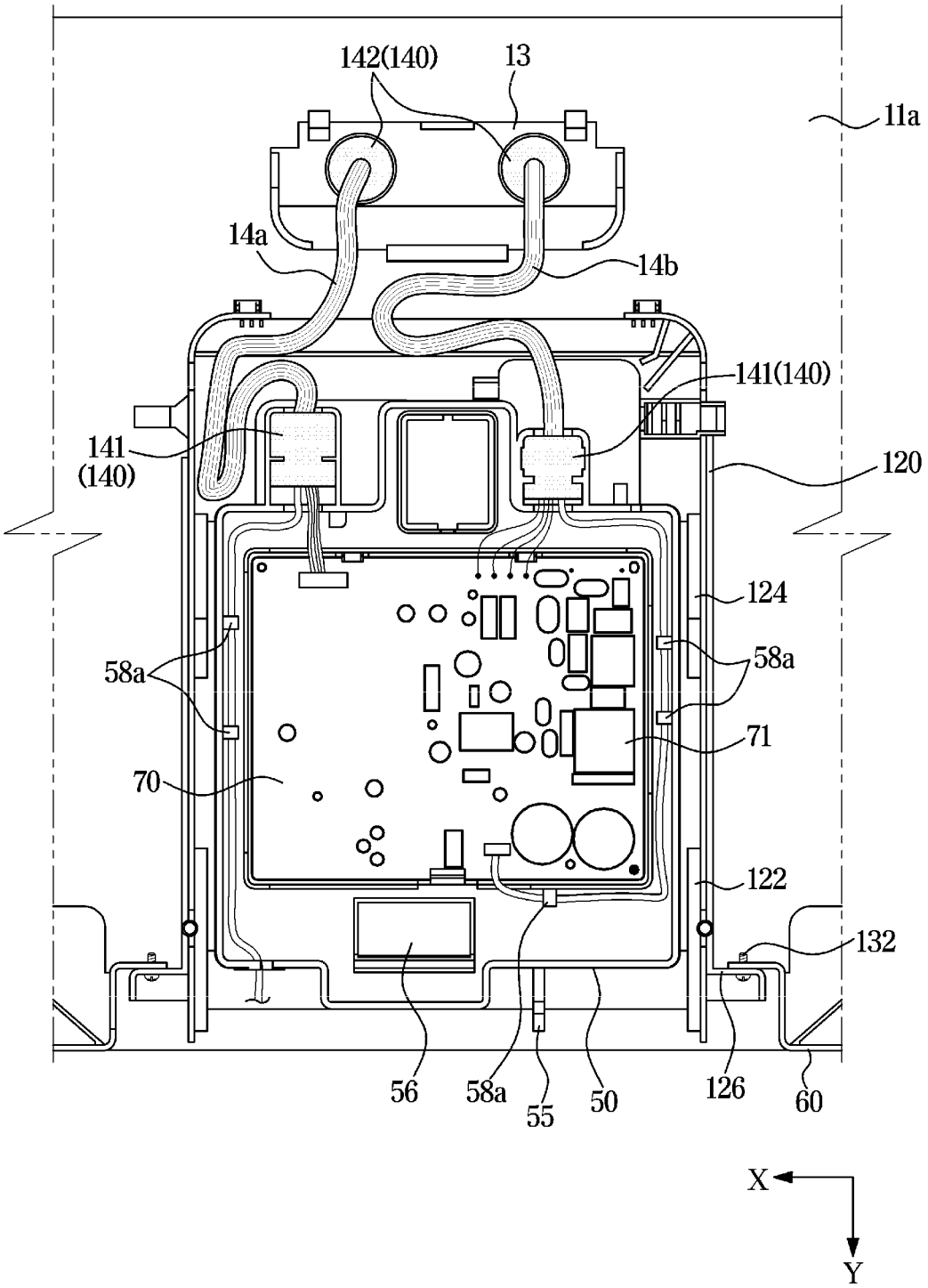
FIG. 15 is a top view of the refrigerator shown in FIG. 14.

FIG. 14 is an exploded perspective view of the refrigerator shown in FIG. 2. FIG. 15 is a top view of the refrigerator shown in FIG. 14. FIG. 15 shows a state of the refrigerator of FIG. 14 after a cover is removed.

Referring to FIGS. 14 and 15, in the refrigerator 1 according to an embodiment of the disclosure, the guide case 100 may include the upper case 110 and the lower case 120. The lower case 120 may be coupled with the top wall 11*d* of the outer case 11. The upper case 110 may cover the lower case 120 from above the lower case 120. The upper case 110 may cover an upper portion and the side plates 120*d* of the lower case 120. Also, the upper case 110 may cover the guide plate 13 and the wire hole 13*a* provided behind the lower case 120. Accordingly, as shown in FIG. 1, because the wire hole 13*a* and the guide plate 13 are not seen, the beauty of the outer appearance of the refrigerator 1 may be improved.

The upper case 110 may include cover plates 111 and 114. The cover plates 111 and 114 may cover the guide case 100, the electric box 50, and the guide plate 13. The cover plates 111 and 114 may extend in the front-back direction. The cover plates 111 and 114 may include a first cover plate 111 and a second cover plate 114. The first cover plate 111 may be positioned above the guide case 100 and the wire hole 13*a*. The first cover plate 111 may cover the guide case 100 and the wire hole 13*a* from above the guide case 100 and the wire hole 13*a*. The second cover plate 114 may be bent from the first cover plate 111 to cover the side plates 120*d* of the guide case 100.

The upper case 110 may include a case rib 112. The case rib 112 may prevent water from entering the inside of the electric box 50. The case rib 112 may be provided at front ends of the cover plates 111 and 114. For example, the case rib 112 may protrude upward from the front end of the first cover plate 111. The case rib 112 may prevent water from flowing to the printed circuit board 70 inside the electric box 50 through the opening 120*h* formed between the upper case 110 and the lower case 120. The case rib 112 is also referred to as a cover rib 112.

The upper case 110 may be screw-coupled with the lower case 120 through a coupling hole 113. For example, a screw 131 may be inserted into the coupling hole 113 and the cover coupling portion 129.

The guide case 100 may further include the buffer 141. Upon taking of the electric box 50 out of the top outer surface 11*a* of the outer case 11, the buffer 141 may reduce tension which is applied to the wire 14. The buffer 141 may be positioned in the buffer accommodating portion 57. A plurality of buffers 141 may be provided.

The refrigerator 1 may further include a preventing member 142. The preventing member 142 may be positioned in the wire hole 13*a*. Foam insulation (not shown) may be provided between the inner case 12 and the outer case 11, and the preventing member 142 may prevent a foaming solution for forming the foam insulation from leaking out of the outer case 11. In addition, the preventing member 142 may also function as a buffer. For example, upon taking of the electric box 50 out of the guide case 100, the preventing member 142 may reduce tension that is applied to the wire 14.

According to a concept of the disclosure, because the electric box is easily detached or attached from or to the main body without requiring a movement of the main body, the service workability of the refrigerator may be improved.

So far, specific embodiments have been shown and described. However, the disclosure is not limited to the above-described embodiments, and various modifications can be made by those skilled in the art without departing from the gist of the technical idea of the disclosure defined by the claims below.

What is claimed is:

1. A refrigerator, comprising:

a main body having a storage room;

a door to open and close the storage room;

an electric box to accommodate a printed circuit board; and a guide case to accommodate the electric box, the guide case comprising a guide rail formed to extend along a front-rear direction of the guide case and the guide rail including a portion that is inclined upward toward a front direction, wherein the guide case is arrangeable on a top surface of the main body such that while the guide case is arranged on the top surface of the main body, the guide rail guides a movement of the electric box accommodated in the guide case with the printed circuit board accommodated therein along the front-rear direction of the guide case.

2. The refrigerator of claim 1, wherein the guide case comprises a lower case to be coupled to the top surface of the main body in which the electric box is to be accommodated, and the lower case is formed to cover both sides of the electric box.

3. The refrigerator of claim 2, wherein the guide rail is formed to protrude from an inner side surface of the lower case toward a side surface of the electric box.

4. The refrigerator of claim 3, wherein the electric box comprises a sliding rail formed to protrude from the side surface of the electric box to be positioned along the guide rail.

5. The refrigerator of claim 4, wherein the guide rail is a first rail including the portion and the guide case comprises:

a second rail provided below the first rail such that the sliding rail is positioned between the first rail and the second rail.

6. The refrigerator of claim 5, wherein the first second rail is formed to include a hole penetrating the second rail, and the electric box comprises a stopper formed to protrude downward from a bottom of the sliding rail and insertable in the hole to thereby couple the electric box to the guide case.

7. The refrigerator of claim 6, wherein the stopper is formed to be separable from the hole as the electric box is moved upward.

8. The refrigerator of claim 7, wherein the guide case comprises:

a third rail spaced from the second rail, behind the second rail and formed to extend along the front-rear direction of the guide case, a fourth rail spaced from the first rail, behind the first rail, formed to extend along the front-rear direction of the guide case and above the third rail; and a rail stopper between a rear end of the third rail and a rear end of the fourth rail.

9. The refrigerator of claim 8, wherein the guide case comprises:

an insertion space between the third rail and the fourth rail such that a rear portion of the sliding rail is insertable into the insertion space, and a front portion of the third rail is inclined downward toward the front direction and a front portion of the fourth rail is inclined upward toward the front direction such that the insertion space is widened toward the front direction.

10. The refrigerator of claim 2, further comprising:

a wire hole through which a wire electrically connected to the printed circuit board passes, the wire hole being formed behind the electric box and the lower case at the top surface of the main body.

11. The refrigerator of claim 10, wherein the guide case comprises:

an upper case positioned above the lower case and the wire hole and covering the lower case and the wire hole.

12. The refrigerator of claim 11, wherein the upper case comprises:

a cover plate formed to extend along the front-rear direction of the guide case and above the guide case and the wire hole; and a case rib formed to protrude upward from a front end of the cover plate.

13. The refrigerator of claim 10, wherein the electric box comprises:

an external wall forming an outer appearance of the electric box;

an inner wall forming an accommodating space in which the printed circuit board is accommodated inside the electric box;

a first guide protrusion formed to protrude from at least one of an outer surface of the inner wall or an inner surface of the external wall, and guide a location of the wire inside the electric box;

a second guide protrusion formed to protrude toward a rear direction of the electric box from a rear plate of the outer external wall;

a guide hole through which the wire passes, the guide hole being formed in the rear plate of the external wall; and a buffer positioned behind the printed circuit board inside the electric box, and provided to surround the wire.

14. The refrigerator of claim 1, further comprising:

a hinge to rotatably couple the door to the main body; and a hinge mounting plate positioned at a front portion of the top surface of the main body, and to couple the hinge to the main body, wherein the guide case comprises:

a lower case to be coupled to the top surface of the main body to accommodate the electric box, an insertion protrusion to be inserted in the top surface of the main body and formed in a rear end of the lower case, and a coupling portion comprising a coupling hole screw-coupled with the hinge mounting plate, the coupling portion being provided in a front end of the lower case.

15. The refrigerator of claim 1, further comprising:

a display to display operation information of the refrigerator, and formed to extend along a left-right direction to cover front sides of the electric box and the guide case.

* * * * *